United States Patent [19]

Takeda et al.

[11] Patent Number: 4,688,534

[45] Date of Patent: Aug. 25, 1987

[54] IDLING SPEED CONTROL DEVICE OF AN INTERNAL COMBUSTION ENGINE

[75] Inventors: Yuji Takeda; Katsushi Anzai; Osamu Harada; Toshio Suematsu, all of Toyota, Japan

[73] Assignee: Toyota Jidosha Kabushiki Kaisha, Toyota, Japan

[21] Appl. No.: 893,010

[22] Filed: Aug. 4, 1986

[30] Foreign Application Priority Data

Aug. 23, 1985 [JP] Japan ..... 60-186185
Sep. 18, 1985 [JP] Japan ..... 60-205816

[51] Int. Cl.[4] ..... F02D 9/02; F02M 3/06

[52] U.S. Cl. ..... 123/339; 123/588

[58] Field of Search ..... 123/179 A, 179 B, 179 G, 123/339, 585, 587, 588

[56] References Cited

U.S. PATENT DOCUMENTS 4,191,051 3/1980 Kawata et al. ..... 123/339
4,414,943 11/1983 Nagase ..... 123/339
4,444,168 4/1984 Matsumura et al. ..... 123/339
4,479,471 10/1984 Hasegawa et al. ..... 123/339
4,484,552 11/1984 Kobayashi et al. ..... 123/339

FOREIGN PATENT DOCUMENTS 0081230 7/1981 Japan .
0162338 9/1984 Japan .

*Primary Examiner*—Willis R. Wolfe, Jr.
*Attorney, Agent, or Firm*—Kenyon & Kenyon

[57] ABSTRACT

An idling speed control device in an internal combustion engine comprising an idling speed control valve arranged in a bypass bypassing the throttle valve of the engine. The valve is fully opened at the start of the engine and closed to a controlled rate when the revolutional speed of the engine reaches a reference rotational value. At least two reference rotational values are provided depending upon a temperature; one of which is a higher value for the considerably high temperature, and the other is a low value for a normal temperature.

14 Claims, 10 Drawing Figures

IDLING SPEED CONTROL DEVICE OF AN INTERNAL COMBUSTION ENGINE

BACKGROUND OF THE INVENTION

1. Field of the Invention

The present invention relates to an idling speed control device of an internal combustion engine, which is adapted for controlling the idling speed of the engine during the start thereof.

2. Description of the Related Art

It is known to arrange an idling speed control valve (ISCV) in a bypass air passage bypassing a throttle valve to control the idling speed of the engine. The amount of the intake air during the idling of the engine can be regulated by the ISCV while the throttle valve is substantially closed. With this arrangement, the ISCV is fully opened when the engine stops, and thus the engine can be restarted with the ISCV fully opened to facilitate the start of the engine. Once the engine starts, the ISCV is closed to a controlled rate, since excess air is neither necessary nor desirable for idle running. The actual start of the engine often can be detected by the revolutional speed of the engine, which reaches a predetermined reference value, thus a substantial control of the ISCV is triggered by the sensed revolutional speed.

There is a problem in an internal combustion engine regarding the restarting capability of the engine when it is started after a short stop period in a hot environment and after a high load or high speed running. If the engine is started in such a condition, the idling speed of the engine tends to decrease or fluctuate, causing the engine to stall and become unable to start again. This is sometimes caused by evaporation of the fuel. Indeed, it is widely recognized that the temperature of the fuel becomes high, for example, during a fifteen to thirty minutes stop period of the engine in a hot environment, causing evaporation of the fuel and reducing the density of the fuel, resulting in a lean air fuel ratio.

It is known, in the case of the above-described type of idling control device, to use two reference rotational values depending upon the temperature of the engine to improve the idling during a cold start of the engine. Namely, a higher reference rotational value is used to obtain a stable idling speed of the engine when the engine is cold, and a lower reference rotational value is used to avoid excessive revolutions, as described above, when the engine is warm. The temperature of the engine is normally represented by the temperature of the engine cooling water, and the warmed up temperature is, for example, approximately 70° C. or higher. Such a temperature is sometimes used as a reference to improve a cold running condition of the engine, but a temperature higher than such a warm up temperature is rarely used for further improving or correcting the running condition of the hot engine.

SUMMARY OF THE INVENTION

It is an object of the present invention to provide an idling speed control device in an internal combustion engine which can improve the starting capability of the engine even when the engine is hot.

According to the present invention, there is provided an idling speed control device in an internal combustion engine, comprising: a first detecting means for detecting the revolutional speed of the engine; a second detecting means for detecting the temperature of the engine; means for regulating the amount of intake air during idling of the engine; means for providing at least two reference rotational values including a first predetermined rotational value when the temperature of the engine is above a predetermined temperature value in a considerably higher range, and a second predetermined rotational value when the temperature of the engine is below said predetermined temperature value, the first predetermined rotational value being greater than the second predetermined rotational value; and, means responsive to outputs of the first and second detecting means for controlling the regulating means to cause the amount of intake air to be increased to a predetermined maximum value when the engine starts, and subsequently, to be decreased from the predetermined maximum value to a controlled value when the revolutional speed of the engine reaches the reference rotational value after the start of the engine. Preferably, the means for providing at least two reference rotational values further provides a third predetermined rotational value when the temperature of the engine is below a second predetermined temperature value lower than the first predetermined temperature value, the third predetermined rotational value being greater than the second predetermined rotational value, and the first predetermined rotational value being greater than the third predetermined rotational value. The second predetermined temperature value can be determined in accordance with the warm up temperature. The first predetermined temperature value is above second predetermined temperature value so that the first predetermined reference value is above the second predetermined reference value which is adapted for the engine in a warmed up condition. Thus the engine is supplied with the predetermined maximum air until the higher first predetermined reference rotational value is established, rapidly replacing the hot fuel in the fuel delivery pipes in the hot environment.

The means for regulating the amount of intake air during idling of the engine preferably comprises a bypass air passage bypassing a throttle valve of the engine, and an electrically operated valve means arranged in the bypass air passage.

BRIEF DESCRIPTION OF THE DRAWINGS

Further features and advantages of the present invention will now be described in greater detail with reference to the preferred embodiments of the present invention and the accompanying drawings, in which.

DESCRIPTION OF THE PREFERRED EMBODIMENTS

Figure 1:
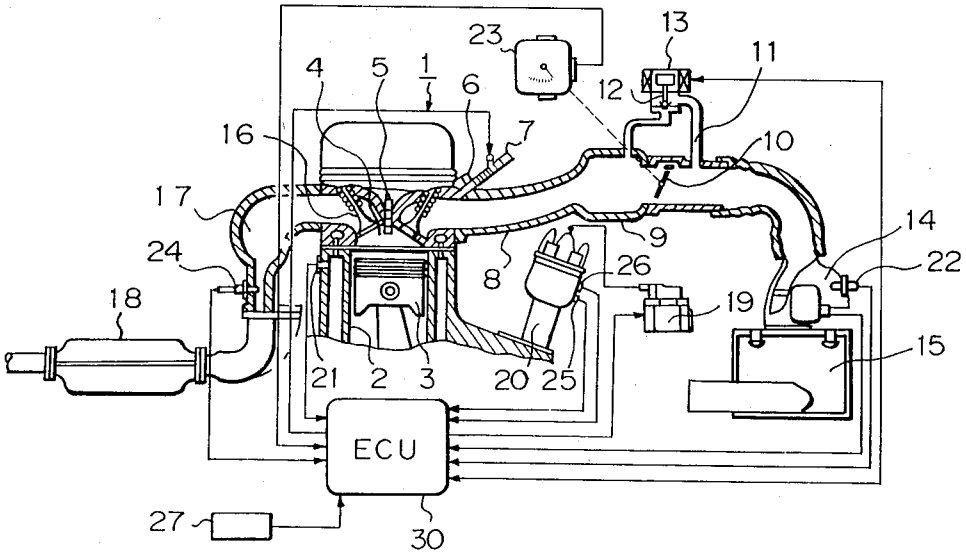
FIG. 1 is a view illustrating an internal combustion engine according to the present invention.

FIG. 1 is a sectional view of a four cycle four cylinder engine 1 provided with an idling control device according to the present invention. FIG. 1 illustrates one of the cylinders 2, and a piston 3 inserted in the cylinder 2 so as to form a combustion chamber 4 therebetween. A spark plug 5 is arranged in the combustion chamber 4. The engine 1 has an intake port having an intake valve 6 arranged therein, and an exhaust port having an exhaust valve 16 arranged therein. An intake manifold 8 is connected to the intake port and a fuel injector 7 is arranged in each branch of the intake manifold 8. An intake air passage 9 including a surge tank is connected to the intake manifold 8.

Figure 2:
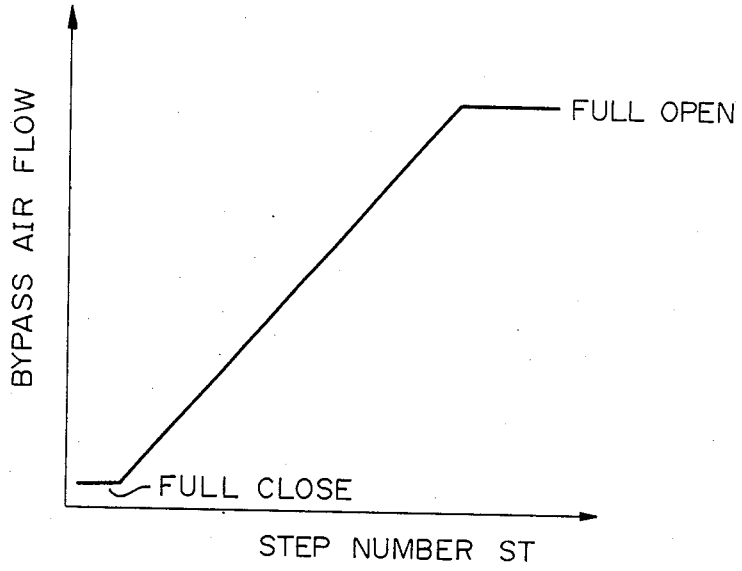
FIG. 2 is a graph illustrating the amount of bypass air relative to the number of the steps of an electric step motor.

A throttle valve 10 is arranged in the intake air passage 9, and a bypass air passage 11 is connected to the intake air passage 9 to bypass the throttle value 10. A flow control valve, called an idling speed control valve (ISCV), 12 is arranged in the bypass air passage 11. The idling speed control valve 12 comprises an electrically operated valve and, in the preferred embodiment, includes a valve element which is operated by an electric step motor 13. Alternatively, the idling speed control valve 12 can be operated by a solenoid. When using the electric step motor 13, the amount of air flowing in the bypass air passage 11 can be controlled in a linear relationship with the number of steps of the electric step motor 13 between the fully open and fully closed positions of the valve 12, as shown in FIG. 2. Therefore, the amount of intake air can be regulated by the idling speed control valve 12, by controlling the electric step motor 13.

An air flow meter 14 and an air cleaner 15 are arranged in the intake air passage 9. Also, an exhaust manifold 17 is connected to the exhaust port, in which a three dimensional catalytic converter 18 for cleaning the exhaust gas is arranged. The engine 1 further has an ignitor 19, including an ignition coil to generate the high potential necessary to ignite the charge, and a transistor control circuit, and a distributor 20 for distributing the high potential generated by the ignitor 19 to the spark plug 5 of each cylinder, synchronously to the crankshaft of the engine.

An electronic control unit (ECU) 30 controls the idling speed control valve 12 as well as the fuel injector 7 and the ignitor 19. For this purpose, a plurality of sensors are provided for detecting operating conditions of the engine 1. Namely, a water temperature sensor 21 is attached to the cylinder block for detecting the temperature of the cooling water of the engine; an air temperature sensor 22 is attached to the air flow meter 14, described above, for detecting the temperature of the intake air; a throttle position sensor 23 is mounted on the shaft of the throttle valve 10 for detecting the opening degree of the throttle valve 10; and an oxygen ($O_2$) sensor 24 is mounted on the exhaust manifold 17 for detecting the remaining oxygen in the exhaust gas. A crank angle sensor 25 is provided in the distributor 20 and outputs twenty-four pulse signals for each revolution of the shaft of the distributor 20, corresponding to each revolution of the crankshaft, and thus is adapted for detecting the rotational speed of the engine 1. A cylinder reference sensor 26 is also provided in the distributor 20 and outputs one pulse signal for each revolution of the shaft of the distributor 20, to detect the reference piston position in the specific cylinder. Further, the signal of a starter 27 for the engine 1 is used.

Figure 3:
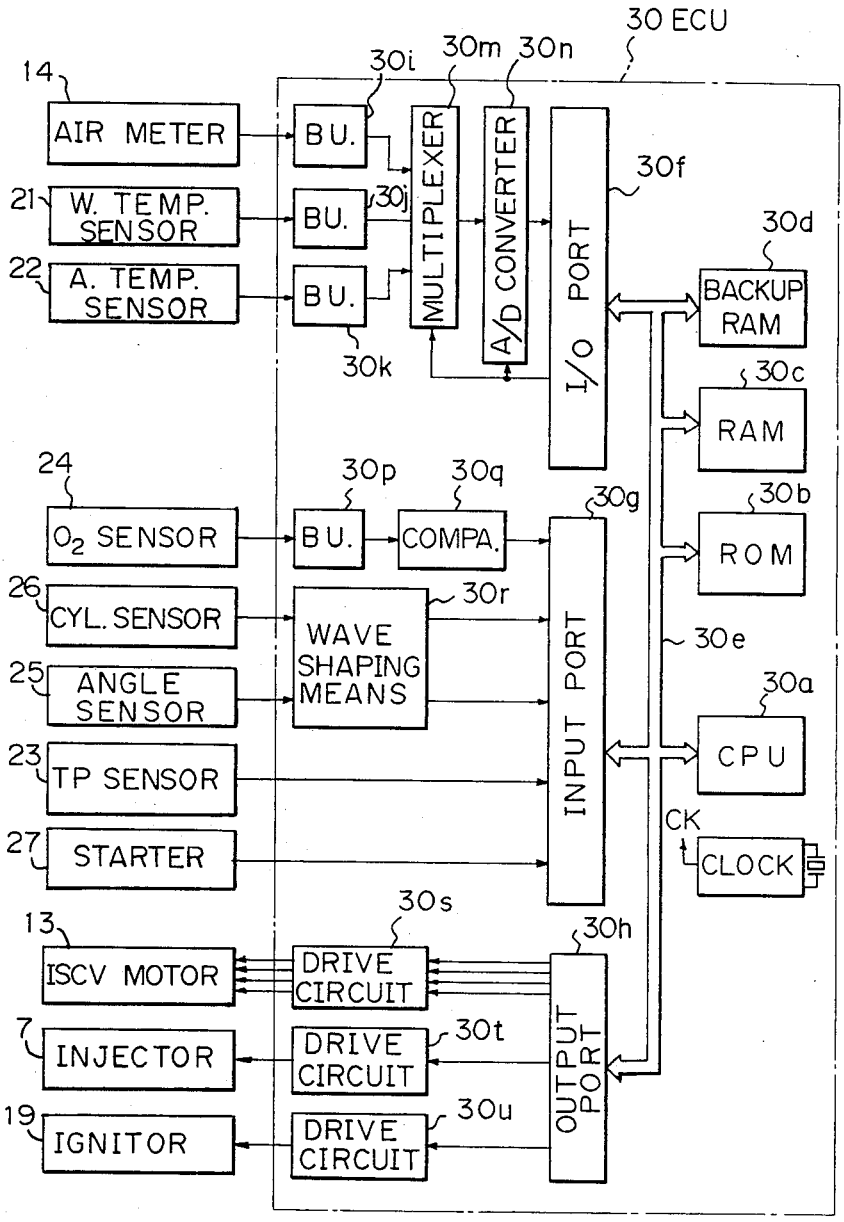
FIG. 3 is a view illustrating details of the electronic control unit in FIG. 1.

FIG. 3 shows a typical arrangement of the electronic control unit (ECU) 30, constituted by an electronic computer system and comprising a central processing unit (CPU) 30*a* for executing a program for controlling the idling speed control valve 12, the fuel injector 7, and the ignitor 19 depending upon the engine operating conditions represented by the outputs from the above described sensors, a read only memory (ROM) 30*b* having program and control information such as a control map stored therein, a random access memory (RAM) 30*c* for temporarily storing input data and arithmetic data, and a backup RAM 30*d* backed up by the battery for storing data which must be held even when the engine 1 is switched off. These components are interconnected by a common bus system 30*e* which further connects an input and output (I/O) port 30*f*, an input port 30*g*, and an output port 30*h*.

The electronic control unit (ECU) 30 further includes buffers 30*i*, 30*j* and 30*k* to receive output signals from the air flow meter 14, the water temperature sensor 21, and the air temperature sensor 22, respectively, a multiplexer 30*m* for optionally outputting the signals from the buffers 30*i*, 30*j* and 30*k* to the CPU 30*a*, and an analog-digital (A/D) converter 30*n* to convert analog signals to digital signals, the signals being input to the CPU 30*a* through the I/O port 30*f*. The CPU 30*a* also receives the detected signals from the oxygen sensor 24 through a buffer 30*p* and a comparator 30*q*, which compares the output voltage by the buffer 30*p* with a reference voltage and outputs a signal when the former is higher than the latter, from the cylinder reference sensor 26 and the crank angle sensor 25 through a wave shaping means 30*r*, and from the throttle position sensor 23 and the starter 27, these signals being input to the CPU 30*a* through the input port 30*g*. The CPU 30*a* delivers the output control signals to the step motor 13 of the idling speed control device 12, the fuel injector 7, and the ignitor 19 through the output port 30*h* and the respective drive circuit means 30*s*, 30*t* and 30*u*, to allow the driving current to be controlled.

Figure 4:
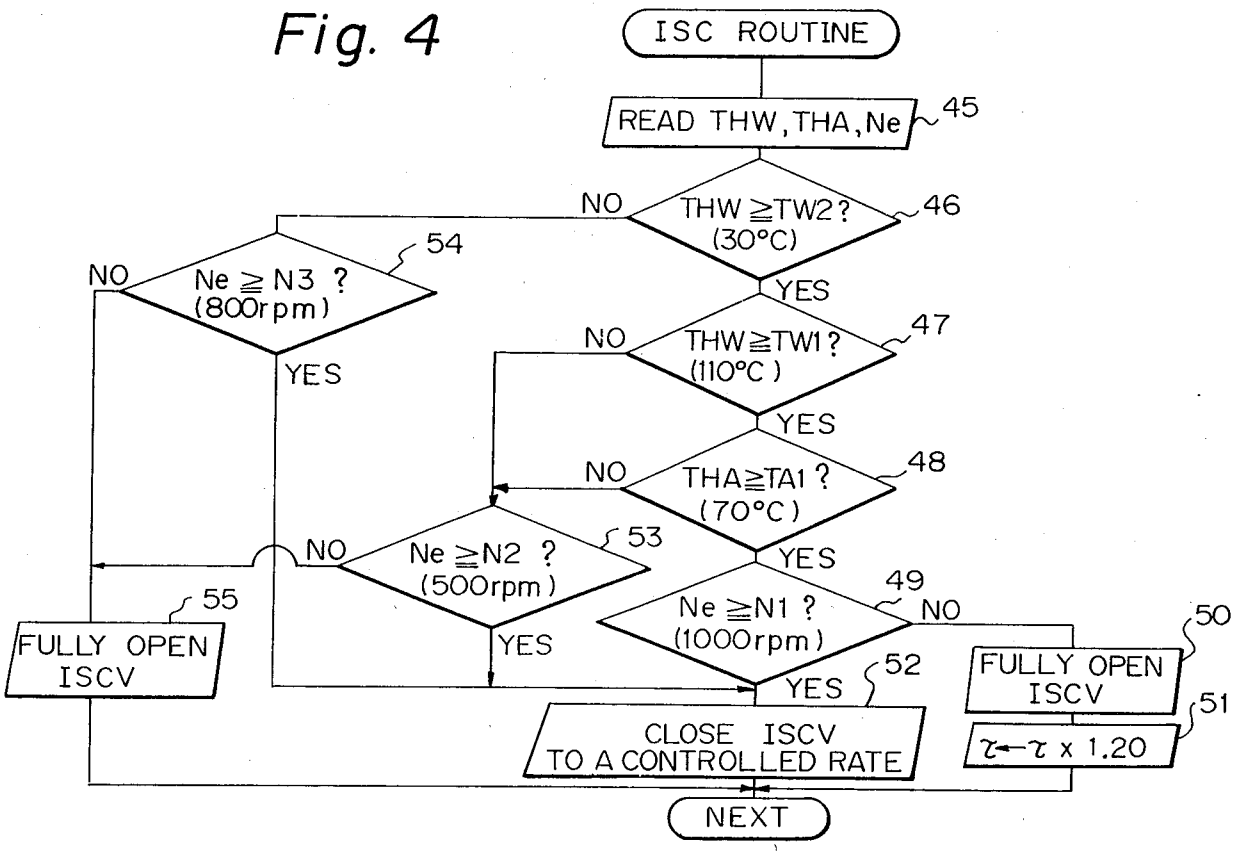
FIG. 4 is a flow chart illustrating an idling speed control executed and embodied according to the present invention.
Figure 5:
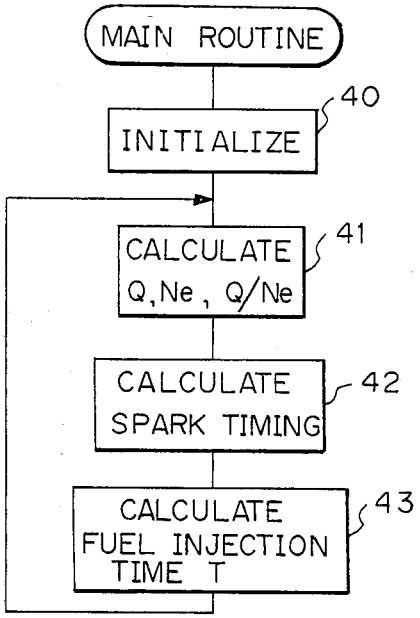
FIG. 5 is a flow chart illustrating a main routine of the electronic control unit.

FIG. 4 shows a flow chart for controlling the idling speed control device of the internal combustion engine (ISC routine), which is executed by an interruption at every four milliseconds in a main routine for controlling the fuel injection and spark timing for the engine, such as shown in FIG. 5 which generally shows that the program is initialized when the engine starts (step 40), and then cyclically calculates the spark timing and the fuel injection time T (steps 42 and 43). Output signals from the above-described sensors are used for calculating the spark timing and the fuel injection time. Step 41 in FIG. 5 exemplarilly shows some of the signals used. It will be clear to a person having ordinary skill in the art that the fuel injection time can be calculated by the amount of the intake air Q and the revolutional speed of the engine Ne, as Q/Ne.

In the idling speed control routine, at step 45, a detected water temperature THW, an air temperature THA, and the revolutional speed of the engine Ne are read in the computer. Depending upon the detected water temperature, three reference rotational values N1, N2, and N3 are prepared and stored in the ROM 30*b*, according to the present invention, as shown in steps 49, 53, and 54 in FIG. 4. These three reference rotational values N1, N2 and N3 are determined depending upon the temperature of the engine, i.e., the temperature of the cooling water. The first reference rotational value N1 is intended for use when the temperature of the engine is higher than a predetermined temperature value TW1 (step 47). This predetermined temperature value TW1 is 110° C. in this preferred embodiment, which is in a considerably higher temperature range than the usual warmed up temperature. The second reference rotational value N2 is to be used when the temperature of the engine is lower than the predetermined temperature value TW1, and the third reference rotational value N3 is to be used when the temperature of the engine is lower than a second predetermined temperature value TW2, which is lower than the first predetermined temperature value TW1. The third reference rotational value N3 for the cold start can be a variable value which increases as the temperature decreases. For an easy understanding of the description, it should be recalled that the idling speed control valve 12 is fully opened when the engine stops, thus it is fully opened when the engine restarts and then is closed to a controlled rate when the revolutional speed of the engine once reaches a reference rotational value, which varies depending upon the detected temperature of the engine.

At step 46, the detected water temperature THW is compared with the second predetermined temperature value TW2 to determine whether the THW is higher than the second predetermined temperature value TW2 (30° C.). If NO at step 46, the program goes to step 54 where the detected revolutional speed Ne is compared with the third reference rotational value N3 (800 rpm), to determine whether Ne is higher than N3. If NO at step 54, i.e., when the revolutional speed Ne has not yet reached the third reference rotational value N3, the program goes to step 55 where the idling speed control valve 12 is controlled to be maintained in the fully open position. When the engine starts in the cold condition, this cycle passing through steps 45, 46, 54, and 55 is repeated until the detected revolutional speed Ne reaches the third reference rotational value N3. Then, when the detected revolutional speed Ne reaches the third reference rotational value N3, the program goes to step 52 to close the idling speed control valve 12 to a controlled rate sufficient to obtain a stable idling condition.

If YES at step 46, the program goes to step 47, where the detected temperature THW is compared with the first predetermined higher temperature value TW1 (110° C.), to determine whether THW is higher than the first predetermined temperature value TW1. If NO at step 47, i.e., when the temperature of the engine is in a normal range between 30° C., and 110° C., the program goes to step 53, which is similar to step 54 but uses the second reference rotational value N2 (500), and then goes to either step 55 or step 52. If YES at step 47, the program preferably passed through step 48, where the detected air temperature THA is compared with a reference air temperature value TA1 (70° C.) to determine whether THA is higher than TA1. If NO at step 48, the program goes to step 53 and then to step 55 or step 52 as in the previous cycle.

YES at step 48 means that the engine is in an extremely hot condition which may cause the fuel to be evaporated. In such a condition, the first higher reference rotational value N1 is used. The program goes to step 49 where the detected revolutional speed Ne is compared with the first reference rotational value N1 (1000 rpm), to determine whether Ne is higher than N1. If NO at step 49, the program goes to step 50 to fully open the idling speed control valve 12 until the engine revolutional speed reaches the first predetermined rotational reference value N1, as in step 55, and then goes to step 52 when the revolutional speed reaches the first predetermined rotational reference value. The program, however, additionally passes through step 51 after passing through step 50. Step 51 means that the fuel injection time period $\tau$, which is calculated and stored, is increased by twenty percent.

It should be noted that a stable idling condition after the start of the engine in the extremely hot condition can be ensured according to the present invention, since the hot fuel including the vapor at the fuel pipes near to the fuel injector can be replaced sooner by the cool fuel by increasing the idling speed to the first predetermined rotational value. The stable idling condition after the start of the engine in the extremely hot condition can be further ensured according to the present invention, since the fuel is increasingly injected despite the hot condition of the engine. This is because the increased fuel corrects the air-fuel ratio which tends to become lean in such a hot condition, due to the formation of vapor.

Figure 6:
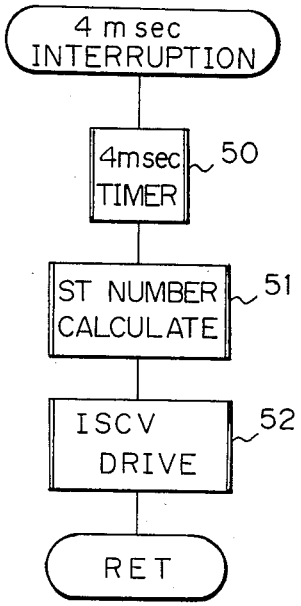
FIG. 6 is a flow chart illustrating a second example of an idling speed control executed and embodied according to the present invention.
Figure 7:
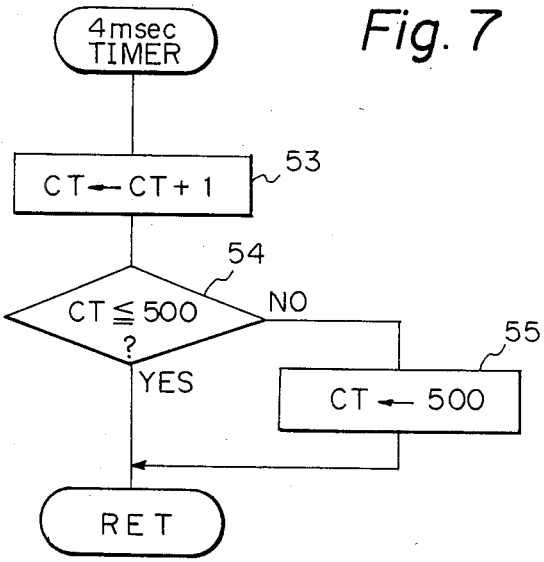
FIG. 7 is a flow chart illustrating in detail one of the steps of FIG. 6.
Figure 8:
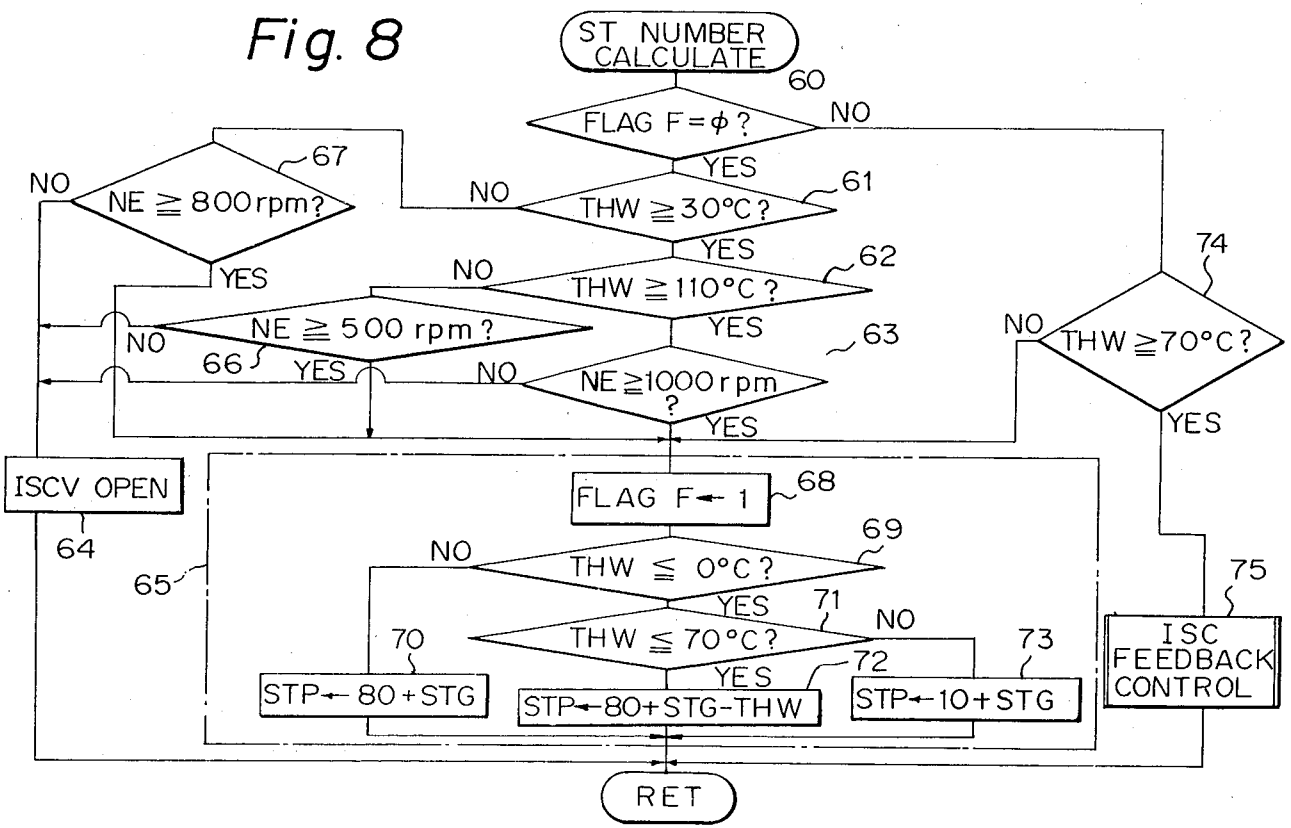
FIG. 8 is a flow chart illustrating in detail another of the steps of FIG. 6.
Figure 9:
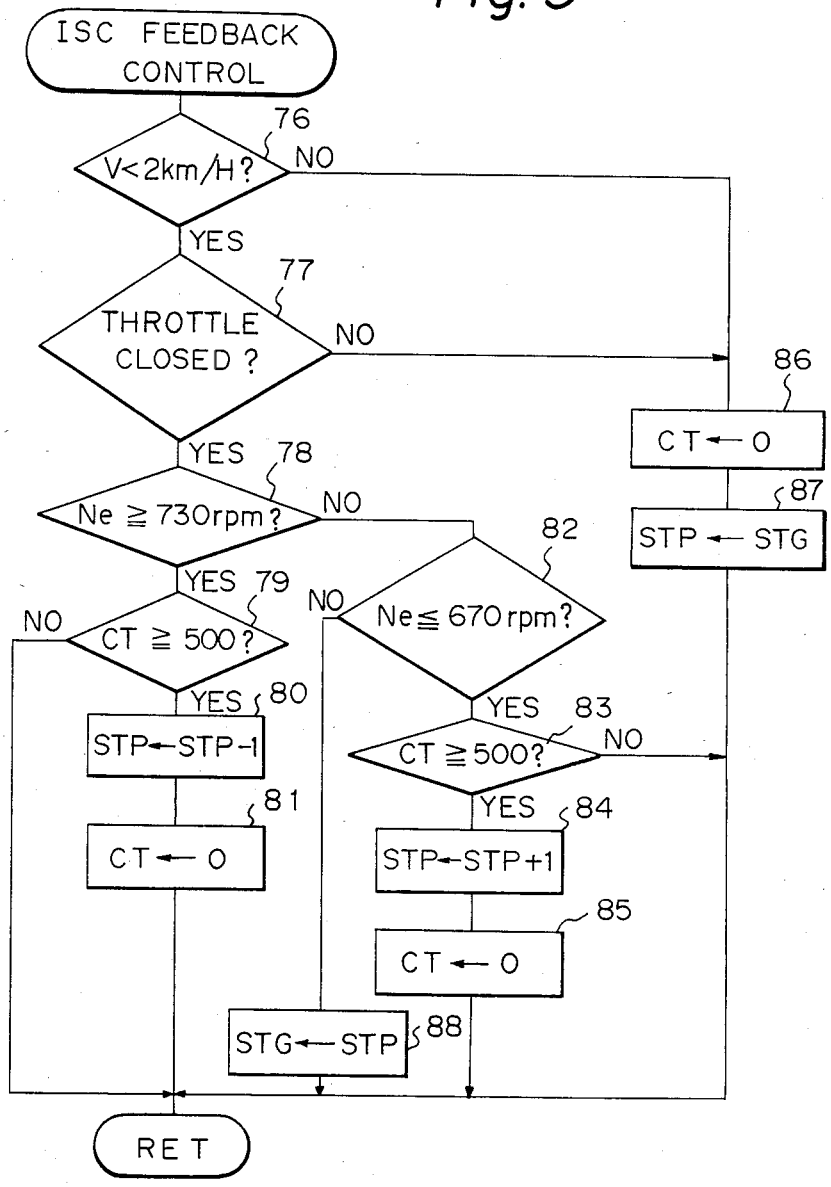
FIG. 9 is a flow chart illustrating in detail one of the steps of FIG. 8.

FIGS. 6 to 9 show a flow chart for controlling the idling speed control valve 12 of a second embodiment of the present invention. FIG. 6 shows the main steps of the idling speed control routine, which is also executed by an interruption at every four milliseconds in a main routine for controlling the fuel injection and spark timing for the engine, as shown in FIG. 5. In FIG. 6, details of the 4 msec TIMER procedure step 50 are shown in FIG. 7; and details of the ST NUMBER CALCULATE step 51 and ISC DRIVE step 52 are shown in FIG. 8. FIG. 9 further shows one of the steps in FIG. 8.

In FIG. 7, the 4 msec TIMER procedure step 50 comprises step 53, in which a counter CT is incremented; step 54, in which it is judged whether the incremented counter CT has reached a predetermined value (500); and step 55, in which the counter CT is stored as the predetermined value (500) when the count exceeds that value. This counter CT is reset to zero at the feedback control step described later. It will be clear that this 4 msec TIMER procedure is used as a timer for two seconds (multiple of 4 msec by 500).

In FIG. 8, step 60 includes a flag F. A zero signal at this flag F represents the condition just after the start of the engine, and thus the flag F is reset to zero at the initialization step 40 in FIG. 5 when the engine starts. It will be seen that steps 61 to 65 in FIG. 8 are similar to steps 45 to 55 in FIG. 4, except that there are fewer processes made in FIG. 8. It is apparent, however, that the omitted process can be added to FIG. 8. Therefore, a repeated description thereof is omitted here. Step 65, however, includes further details of steps 68 to 73. FIG. 8 further includes steps 74 and 75, which effect a feedback control for the idling speed control valve 12 after the program has once passed through step 65 (NO at step 60) and after the temperature of the engine reaches the warmed up temperature (70° C., YES at step 74).

As can be seen, the program first goes to 65 when the revolutional speed of the engine reaches one of the reference rotational values (1000, 500, 800 rpm) determined in accordance with the temperature. When passing step 68, the flag F is set to 1, thus the next cycle will go from step 60 to step 74 and then from step 74 to step 65 or 75. At step 69, the temperature of the engine is compared with a predetermined value (0° C.). If the temperature of the engine is below 0° C., the number of steps STP for the step motor 13 of the idling speed control valve 12, as described in reference to FIG. 2, is calculated by the addition of eighty plus STG (step 70). STG is a learning value of the STP before the engine is previously stopped, and is stored in the backup RAM 30*d*. If the temperature of the engine is higher than 0° C., this engine temperature is compared with a further predetermined value (70° C., step 71). If the temperature of the engine is lower than 70° C., the number of steps STP is determined by the result of the calculation of eighty plus STG minus THW (step 72). This varies, depending upon the temperature, to ensure an optimum idling speed. If the temperature of the engine is higher than 70° C., the number of steps STP is calculated by the addition of ten plus STG (step 73).

FIG. 9 shows details of the feedback control step 75 in FIG. 8. The idling condition is first detected at steps 76 and 77, by sensing that the speed of the automobile is substantially zero ($V<2$ km/H) and that the throttle valve 10 is closed. The program then goes to step 79, where the revolutional speed of the engine is compared with an upper limit value (730 rpm). If the detected revolutional speed is higher than the upper limit value, the counter CT is checked at step 79 to determine whether the count has reached 500. If the count is under 500, the procedure ends and the STP is not changed. If the count has reached 500, the program goes to step 80 where the STP is decremented by one, and goes to step 81 where the counter CT is reset. It can be understood from the above that the idling speed is corrected when the revolutional speed has exceeded the upper limit for two seconds.

If the detected revolutional speed is lower than the upper limit at step 79, the program goes to step 82 and the revolutional speed of the engine is compared with a lower limit value (670 rpm). NO at step 82 means that the revolutional speed of the engine is in a satisfactory range between the upper and the lower limits, and thus the STP is not changed and STG is set by that STP as a learning value (step 88). If the detected revolutional speed is lower than the lower limit at step 82, the program goes to step 83 and the counter CT is checked to determine whether the count has reached 500. If the count is under 500, the procedure ends and the STP is not changed. If the count has reached 500, the program goes to step 84 where the STP is incremented by one and goes to step 85 where the counter CT is reset. It can be understood from the above that the idling speed is corrected when the revolutional speed remains lower than the lower limit for two seconds.

When the idling condition is not detected at steps 76 and 77, the program goes from step 76 or 77 to step 86, where the timer CT is reset. At step 87, the STP can be obtained by the STG, if necessary. A described with reference to FIGS. 8 and 9, the number of the steps STP for the step motor 13 of the idling speed control valve 12 is determined. The number of the steps STP for the step motor 13 is proportional to the amount of the air to be intaken during the idling of the engine, as described with reference to FIG. 2. The idling speed control valve 12 can be driven at step 52 in FIG. 6 with that STP. Alternatively, the idling speed control valve 12 can be constructed by a solenoid-operated valve. It is known to drive a solenoid-operated valve under the duty control, and therefore, it is possible to drive the solenoid-operated idling speed control valve by suitably determining a duty cycle in place of the STP for the step motor.

Figure 10:
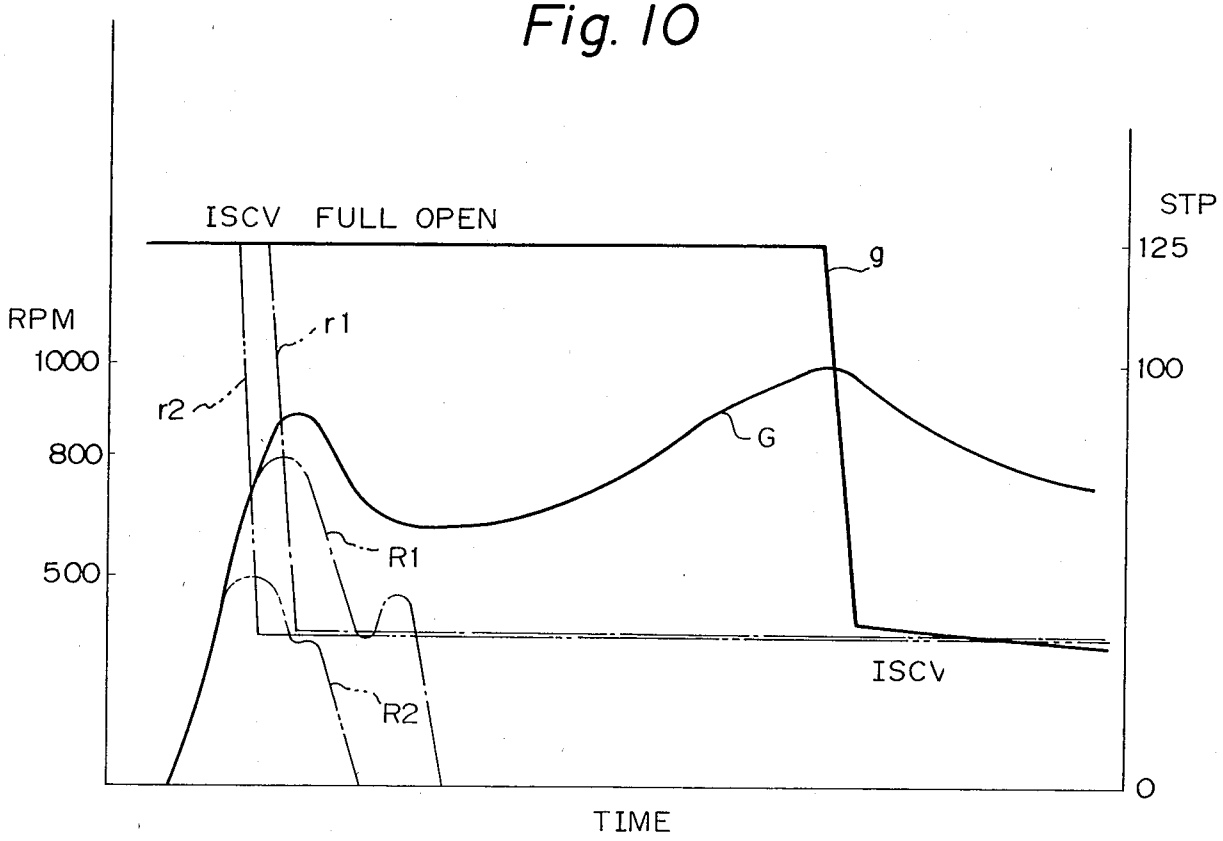
FIG. 10 is a graph illustrating the idling speed after the engine is started in a hot environment.

FIG. 10 shows changes of the revolutional speed of the engine when started in a hot environment, and corresponding changes of the STP. The solid curve G illustrates the revolutional speed when the first reference rotational value N1 is 1000 rpm, as applied in the preferred embodiments of the present invention as shown in FIGS. 4 and 8. In FIG. 10, the solid line g illustrates the change of the STP corresponding to the curve G; a dotted line R1 illustrates the revolutional speed when the first reference rotational value N1 is 800 rpm; and a dotted line r1 illustrates the corresponding STP. A two-dot one-dash line R2 illustrates the revolutional speed when the first reference rotational value N1 is 500 rpm, and another two-dot one-dash line r2 illustrates the corresponding STP. As can be seen in FIG. 10, the engine may stall just after the revolutional speed reaches the first reference rotational value N1 if the first reference rotational value N1 is relatively low, such as 800 rpm or 500 rpm. If, however, the first reference rotational value N1 is relatively high, such as 1000 rpm which is higher than the second reference rotational value N2 (500 rpm) for the normal temperature range or the third reference rotational value N3 (800 rpm) for the cold temperature range, the revolutional speed G may drop slightly but will immediately recover and maintain a relatively high idle speed just below 1000 rpm due to the full opening of the idling speed control valve. Accordingly, a stable idling condition can be obtained.

We claim:

1. An idling speed control device of an internal combustion engine, comprising:

a first detecting means for detecting a revolutional speed of said engine;

a second detecting means for detecting a temperature of said engine;

means for regulating an amount of intake air during idling of said engine;

means for providing at least two reference rotational values including a first predetermined rotational value when the temperature of said engine is higher than a predetermined temperature value in a considerably higher range, and a second predetermined rotational value when the temperature of said engine is lower than said predetermined temperature value, the first predetermined rotational value being greater than the second predetermined rotational value; and means responsive to outputs of said first and second detecting means for controlling said regulating means to cause said amount of intake air to be increased to a predetermined maximum value when said engine is started, and subsequently, to be decreased from said predetermined maximum value to a controlled value when the revolutional speed of said engine reaches the reference rotational value after the engine has started.

2. An idling speed control device according to claim 1, wherein said engine has an intake air passage having a throttle valve arranged therein, and said means for regulating the amount of intake air during idling of said engine comprises a bypass air passage bypassing said throttle valve, and a valve means arranged in said bypass air passage.

3. An idling speed control device according to claim 2, wherein said valve means includes a valve element and an electric step motor for operating said valve element.

4. An idling speed control device according to claim 2, wherein said valve means comprises a solenoid-operated valve.

5. An idling speed control device according to claim 2, wherein said means for providing at least two reference rotational values further provides a third predetermined rotational value when the temperature of said engine is lower than a second predetermined temperature value lower than said first predetermined temperature value, the third predetermined rotational value being greater than the second predetermined rotational value.

6. An idling speed control device according to claim 5, wherein the first predetermined rotational value is greater than the third predetermined rotational value.

7. An idling speed control device according to claim 6, wherein said first, second, and third predetermined rotational values are 1000, 500, and 800 rpm, respectively.

8. An idling speed control device according to claim 7, wherein said third predetermined rotational value increases as the temperature decreases.

9. An idling speed control device according to claim 2, wherein said second detecting means comprises a temperature sensor for detecting a temperature of cooling water of the engine.

10. An idling speed control device according to claim 9, wherein said first predetermined temperature value is higher than 100° C.

11. An idling speed control device according to claim 9, wherein said device further comprises a temperature sensor for detecting a temperature of the intake air, and said first predetermined rotational value is selected when the temperature of the cooling water is higher than a first value and the temperature of the intake air is higher than a second value.

12. An idling speed control device according to claim 11, wherein said first value is 110° C. and said second value is 70° C.

13. An idling speed control device according to claim 2, wherein a learning value is used for determining said controlled value when the revolutional speed of the engine reaches the reference rotational value, said learning value being determined by an opening value of said valve means when the idling speed is between predetermined higher and a lower limits during previous running of the engine before the engine is restarted.

14. An idling speed control device according to claim 2, wherein said device further comprises a fuel supply means which supplies an increased amount of fuel when the temperature of said engine is higher than said predetermined temperature value, and does not supply an increased amount of fuel when the temperature of said engine is lower than said predetermined temperature value.

* * * * *